US012723757B2

(12) United States Patent
Bauer et al.

(10) Patent No.: US 12,723,757 B2
(45) Date of Patent: Sep. 1, 2026

(54) METHOD OF STARTING A BURNER DEVICE AND HEATING DEVICE HAVING A BURNER DEVICE

(71) Applicant: TRUMA GERAETETECHNIK GMBH & CO. KG, Putzbrunn (DE)

(72) Inventors: Christian Bauer, Putzbrunn (DE); Jörgen van Koppen, Putzbrunn (DE)

(73) Assignee: Truma Geraetetechnik Gmbh & Co. KG, Putzbrunn (DE)

( * ) Notice: Subject to any disclaimer, the term of this patent is extended or adjusted under 35 U.S.C. 154(b) by 393 days.

(21) Appl. No.: 18/571,915

(22) PCT Filed: Mar. 22, 2022

(86) PCT No.: PCT/EP2022/000030

§ 371 (c)(1),
(2) Date: Dec. 19, 2023

(87) PCT Pub. No.: WO2023/280431

PCT Pub. Date: Jan. 12, 2023

(65) Prior Publication Data

US 2024/0310045 A1 Sep. 19, 2024

(30) Foreign Application Priority Data

Jul. 9, 2021 (DE) ..... 102021003528.3

(51) Int. Cl.
*F23N 5/24* (2006.01)

(52) U.S. Cl.
CPC ..... *F23N 5/242* (2013.01); *F23N 2225/14* (2020.01); *F23N 2227/02* (2020.01); *F23N 2227/42* (2020.01)

(58) Field of Classification Search
CPC ..... F23N 5/242; B60H 1/2206
USPC ..... 431/6, 66, 67, 72, 262, 29–31
See application file for complete search history.

(56) References Cited

U.S. PATENT DOCUMENTS

| | | | | |
|---|---|---|---|---|
| 4,891,004 A * | 1/1990 | Ballard | F23N 5/203 236/11 |
| 4,934,924 A * | 6/1990 | Nakai | B60H 1/2209 431/325 |
| 2014/0236460 A1* | 8/2014 | Neely | F02P 19/028 701/113 |

FOREIGN PATENT DOCUMENTS

| | | |
|---|---|---|
| DE | 19924329 A1 | 9/2000 |
| DE | 10140972 A1 | 3/2003 |
| DE | 102004062831 A1 | 7/2006 |
| DE | 102008008895 | 8/2009 |
| EP | 0271999 A1 | 6/1988 |

* cited by examiner

*Primary Examiner* — Vivek K Shirsat
(74) *Attorney, Agent, or Firm* — McNees Wallace & Nurick LLC

(57) ABSTRACT

Example embodiments relate to a method of starting a burner device. The temperature of the combustion air is measured, and a temperature-dependent set value of the heating energy of a glow element is specified. Example embodiments also relate to a heating device having a burner device.

11 Claims, 2 Drawing Sheets

METHOD OF STARTING A BURNER DEVICE AND HEATING DEVICE HAVING A BURNER DEVICE

FIELD OF DISCLOSURE

The present disclosure relates to a method of starting a burner device. The present disclosure also relates to a heating device having a burner device which is started using the method.

BACKGROUND

For starting a vaporizer burner for liquid fuels, it is first necessary to supply thermal energy from the outside. Usually, the thermal energy is introduced by an electrically driven ignition body—the so-called glow element. Such a glow element converts electrical energy into thermal energy due to its ohmic internal resistance. This results in temperatures of more than 1000° C. at the surface of the usually ceramic components. Document DE 10 2004 062 831 A1 or DE 199 24 329 A1, for example, deals with the starting of burner devices in heating systems.

Accordingly, there is a need to propose a method of starting a burner device which is as ecologically as possible.

SUMMARY

The present disclosure relates to a heating device having a burner device which is started accordingly.

The present disclosure is achieved by a method of starting a burner device, wherein a mixture of combustion air and a fuel is burnt in the burner device, wherein a combustion process of the burner device is started by a glow element, and wherein the method comprises at least the following steps: a temperature of the combustion air is measured, and a set value of the heating energy of the glow element is specified as a function of the measured temperature.

In the prior art, the aim that the combustion process can be started at any external temperature is achieved by setting the electrical energy supplied to the glow element to the lowest temperature values. However, the present disclosure is based on the findings that it is possible to work with less heating energy at higher temperatures. Electrical energy can thus be saved in cases with higher external temperatures. Furthermore, the glow element is therefore less stressed. In addition, the starting process is shortened at warmer external temperatures. For example, the temperature-dependent set values of the heating energy are determined on the basis of measurements at the burner device or at the respective type of burner device. In one configuration, the electrical power of the glow element is also set in accordance with a specified set value in addition to the heating energy.

One configuration provides that the method further comprises the following step: the heating energy of the glow element is increased until the set value of the heating energy has been exceeded. Alternatively, the set value is only reached, and no further increase is performed.

One configuration includes that the method further comprises the following steps: a scaled set value of the heating energy is specified as a function of the measured temperature, wherein the scaled set value is smaller than the set value, the combustion air is conveyed into the burner device in the event that the scaled set value of the heating energy of the glow element is reached. In one configuration, the scaled set value is between 50% and 100% of the set value. In this configuration, the combustion air is conveyed into the combustion device earlier, before the set value of the glow element has been reached. In one configuration, the scaled set value depends on the characteristics of the combustion air fan and in particular on the time required by the fan for reaching a set rotational speed.

One configuration provides that the method further comprises the following step: the fuel is conveyed into the burner device in the event that the set value of the heating energy of the glow element is reached. In this configuration, the fuel is conveyed at the moment at which a desired temperature has been produced by the glow element, to vaporize by means of the glow element. In a combination of this configuration with the previous one, first combustion air and then fuel are supplied. It is thus ensured that combustion air is available for the combustion.

One configuration includes that the method further comprises the following steps: it is monitored in the burner device whether a flame is present, a delay time is specified, and the glow element is operated during the delay time after a point in time at which the presence of a flame has been determined. In this configuration, the glow element remains active for a certain time even after the flame has been detected, such that a reliable combustion is achieved and the flame does not extinguish again, for example, because sufficiently stable combustion conditions have not yet developed. In one configuration, the delay time is specified as a function of the measured temperature. In this case, the delay time is longer at lower temperatures and shorter at higher temperatures. Thus, the advantage is achieved that at lower temperatures, the flame is prevented from extinguishing. At higher temperatures, it is prevented that thermoacoustic effects are generated by the glow element.

One configuration provides that the method further comprises the following steps: the glow element is switched on at the beginning of the starting process and is operated it at a rated power, and a path passing the combustion air in the burner device is purged with combustion air at the beginning of the starting process. In this configuration, when the combustion process is started, the area in which the combustion occurs, i.e. a combustion chamber for example, is first purged with combustion air, such that any remaining residues of flue gas or unburnt fuel-air mixture are reliably removed. Furthermore, it should be ensured that a temperature sensor measuring the temperature of the supplied air is also entirely surrounded by this fresh air and not by air from the system of the burner device (i.e. a heating device, for example).

One configuration of the method as an expansion of the previous configuration includes that the temperature of the combustion air is measured after having purged the path. The measurement of the combustion air is necessary to determine the set value of the heating power. The measurement is here carried out after purging, i.e. after a well-defined basic state has been generated for the burner device.

One configuration provides that the method further comprises the following steps: a stabilization time is specified, and a regulation of the burner device is started only after the stabilization time has elapsed after switching off of the glow element. The burner device is regulated, for example, as a function of a predetermined temperature of the water to be heated or of the space to be heated. In this configuration, this regulation is carried out after a certain time has elapsed within which the combustion process stabilizes.

According to a further teaching, the present disclosure relates to a heating device for heating air and/or for heating a liquid, comprising a burner device which generates thermal energy by the combustion of a fuel-air mixture, a heat exchanger which transfers the thermal energy generated by the burner device to the air and/or liquid, and a control device, wherein the burner device includes a glow element, a combustion air fan, a fuel pump, and a temperature sensor for measuring the temperature of the combustion air, and wherein the control device is configured so as to perform the method according to any of the aforementioned or following configurations.

One configuration of the heating device provides that the burner device further includes a sensor for detecting a flame in the burner device.

BRIEF DESCRIPTION OF DRAWINGS

The aforementioned and the following configurations and embodiments as to the method also apply accordingly to the heating device which implements the method. To avoid repetitions, reference is thus made to the remaining description.

Specifically, there are a large number of possibilities for designing and further developing the method according to the present disclosure and the heating device. To this end, reference is made, on the one hand, to the claims subordinate to the independent claims, and, on the other hand, to the description below of example embodiments in conjunction with the drawing, in which:

DETAILED DESCRIPTION OF EXAMPLE EMBODIMENTS

Figure 1:
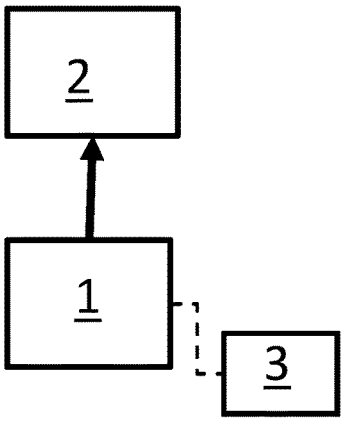
FIG. 1 shows a schematic representation of the heating device.

FIG. 1 shows a heating device very schematically. A fuel-air mixture is burnt in a burner device 1, and the thermal energy thus released is transferred to air or a medium such as raw water in a heat exchanger 2. In particular, the flue gas generated in the burner device 1 is supplied to the heat exchanger 2. The starting process of the burner device 1 described below is controlled by the control device 3.

Figure 2:
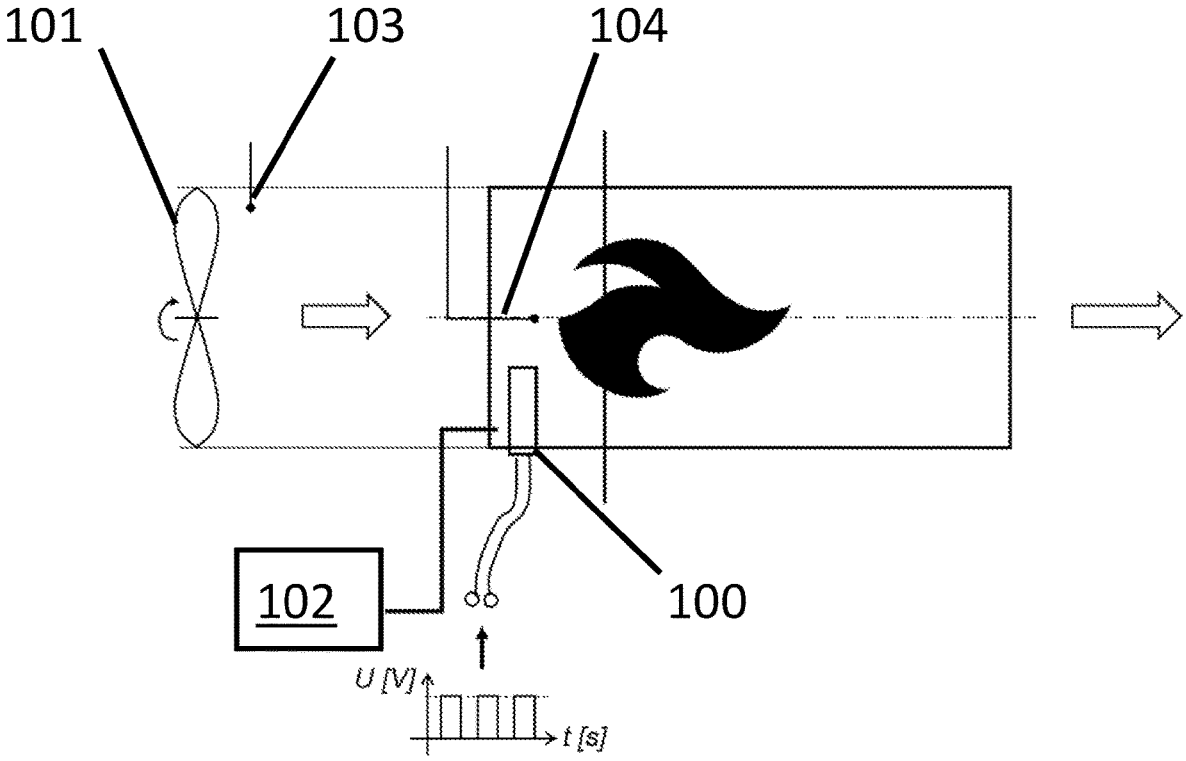
FIG. 2 shows a schematic representation of the burner device.

The burner device schematically represented in FIG. 2 has a combustion chamber in which the fuel-air mixture is burnt and the resulting flue gas (see arrow on the right side) is here evacuated to the right to be transferred to room air or raw water, for example, via the heat exchanger. The combustion process is started by the glow element 100. It is indicated here that a pulse-modulated electrical voltage is applied to the glow element 100. The temperature thus resulting at the glow element 100 causes the vaporization of a fuel, a Diesel fuel for example, and thus to the generation of a fuel-air mixture. The required combustion air (indicated by the left arrow) is supplied via the combustion air fan 101. The fuel is introduced into the combustion chamber via a fuel pump 102. This takes place in particular in the immediate vicinity of the glow element 100 such that the liquid fuel vaporizes in the temperature environment generated—by the glow element 100. A self-sustaining flame (here indicated symbolically) has formed after a certain period of time, and the glow element 100 can be switched off. The sensor 104 in the combustion chamber is used to detect the flame.

A temperature sensor 103 measuring the temperature of the supplied combustion air is provided for the starting process described below. Signals from the sensors for the flame 104 and for the temperature of the combustion air 103 are fed to the control device 3 illustrated in FIG. 1. In addition, the control device 3 controls the glow element 100—more precisely the driving of the glow element 100—, the fuel pump 102 and the combustion air fan 101.

Figure 3:
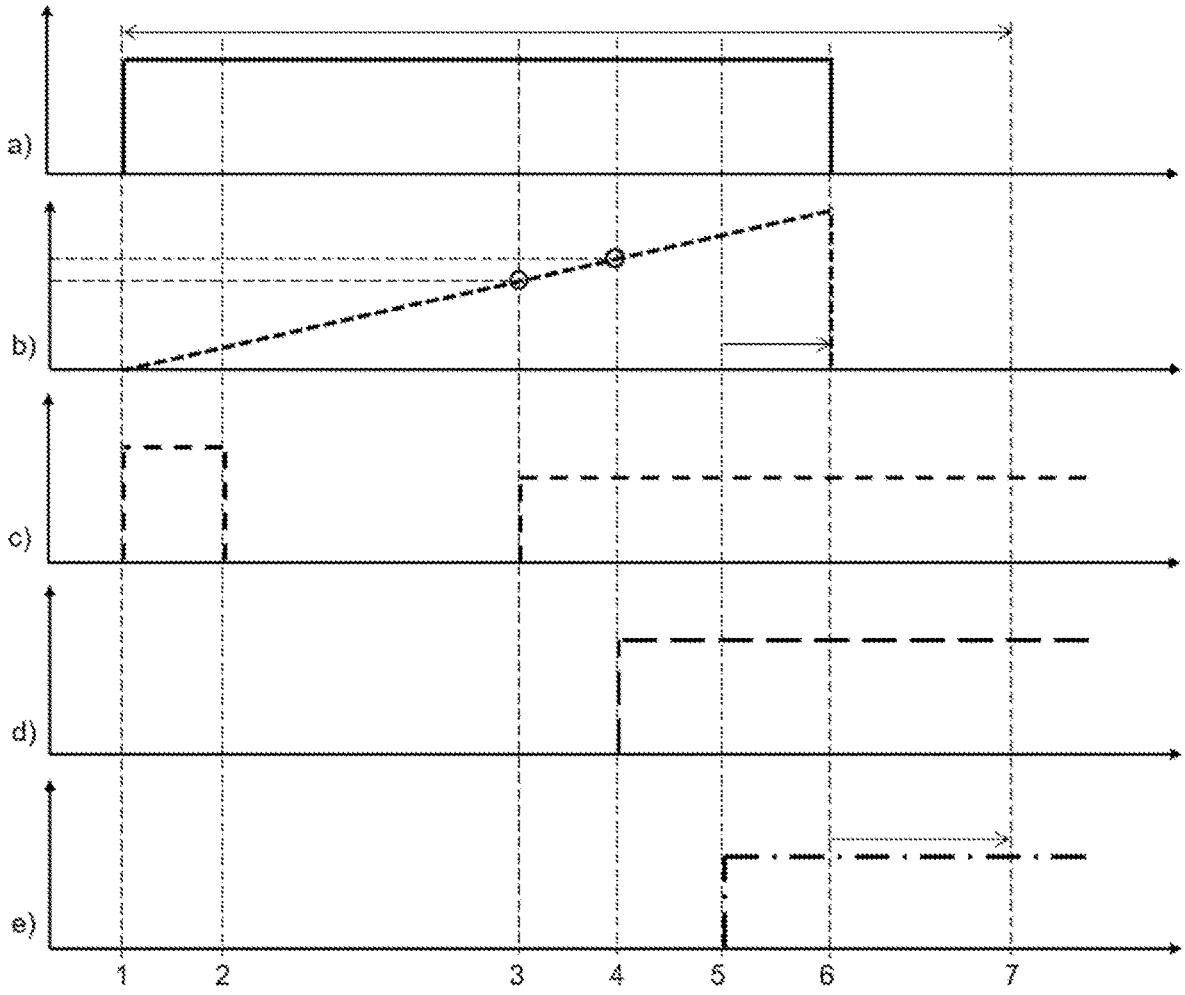
FIG. 3 shows a schematic representation of the course of the starting process of the burner device.

FIG. 3 schematically shows an example of the course of the starting of the burner device. The starting phase takes place between times 1 and 7.

The top line a) shows the rated power of the glow element plotted against time t. At the beginning of the method, the glow element is switched on at time 1 and is operated at its rated power, which is regulated by measuring the current and the voltage and by setting a PWM-voltage (an electrical voltage regulated by pulse width modulation). The glow element is switched off at time 6, i.e. before the end of the starting phase.

Line b) illustrates the course of the heating energy of the glow element as a function of time t. The energy is calculated, for example, by numerical integration of the power. The ramp-shaped course which is formed up to a maximum at time 6 can be seen. If the power of the glow element is constantly regulated between times 3 and 4, it can be assumed that the increase in energy is linear. A scaled set value and a set value of the heating energy are also plotted.

Line c) shows the driving of the combustion air fan in relation to the set rotational speed. The fan is first operated between times 1 and 2 and is then switched off. The fan is only switched on again at time 3 to then be operated permanently. It is indicated that the rotational speed and thus the speed of the fan between times 1 and 2 is higher than after time 3, i.e. during normal operation of the burner device. A set rotational speed is specified for normal operation. In one configuration, the set rotational speed is specified as a function of the measured temperature of the combustion air.

Line d) shows the activation of the fuel supply. The fuel is introduced into the combustion chamber as from time 4 and also beyond the end of the starting phase.

Line e) relates to the sensor for detecting the flame. The time at which the flame and thus the beginning of the combustion phase are detected is referred to as time 5. From time 5, the combustion therefore takes place permanently or a flame is permanently present.

The cooperation of the individual components or events when starting the combustion process is described below.

Simultaneously with the switching on of the glow element at time 1, the combustion air fan is started and operated until the combustion path, i.e. in particular the combustion chamber has been purged with fresh air. The fan is therefore switched off at time 2. The duration between times 1 and 2 can be set such that it is ensured that fresh air reaches the temperature sensor. The specified time therefore depends on how long it takes to convey the fresh air. The duration can therefore be measured on the basis of the conditions of the burner device installed in the heating device, for example. Alternatively, the duration is specified as a function of a maximum exhaust gas or fresh air path, as a function of the respective line cross-sections and the characteristics of the fresh air fan, for example the fan speed and/or the volume flow which can be generated.

After the fan is switched off, the temperature of the combustion air is determined based on the measurement of the temperature sensor. This is realized at time 2. Based on the temperature, three set values are determined for driving the glow element, i.e. calculated by interpolation—preferably using a data table and/or for example a relationship described by mathematical formulae: these are, on the one hand, a set value for the heating energy and, on the other hand, a scaled set value preferably between 50% and 100%. Finally, this is the set value for the delay time which is shorter as the measured temperature increases (see further explanations). The set value of the heating energy or the energy set value depends on the temperature of the combustion air, if a higher temperature is associated with a lower set value and a lower temperature is associated with a higher set value. The warmer the combustion air is, the less thermal energy has to be provided by the glow element. The relationships between the set value and the temperature of the combustion air are determined from comparative measurements, for example. The scaled set value is for example determined from a scaling value between 0.5 and 1 and the set value. The time required by the combustion air fan to reach the set rotational speed necessary for operation is relevant to the scaling value. If the fan accelerates quickly, the time can be shorter. If the fan increases its rotational speed only slowly, the delay time is to be set longer. As can be seen in line b), the glow element is driven such that the heating energy thereof increases continuously. The power and energy are continuously monitored based on the measuring of the voltage and the current.

The fan for the combustion air is switched on at the time at which the scaled set value of the heating energy has been reached, i.e. here at time 3. If the set value is then reached at time 4, the pump device is started such that combustion air and fuel are present in the combustion chamber. Furthermore, the fan has preferably reached its set number of revolutions at time 4. In one configuration, the heating energy of the glow element is no longer determined after this time 4. The calculation of the energy from the measured values for the current and the voltage is for example stopped. The heating energy of the glow element is increased by the further driving, starting from the rated or set power beyond the set value.

At time 5, it is recognized that there is a flame, i.e. that the mixture of combustion air and fuel has ignited. The glow element which is still active supports the development of the flame during a delay time from time 5 to time 6. The glow element is switched off at time 6.

A stabilization time extends up to time 7 after which it is assumed that a combustion state has been reached which permits normal operation of the burner device or the heating apparatus.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

LIST OF REFERENCE NUMERALS

1 Burner device
2 Heat exchanger
3 Control device
100 Glow element
101 Combustion air fan
102 Fuel pump
103 Temperature sensor
104 Sensor for detecting a flame

The invention claimed is:

1. A method of starting a burner device, wherein a mixture of combustion air and fuel is burnt in the burner device, wherein a burning process of the burner device is started by a glow element, the method comprising:

measuring a temperature of the combustion air, and determining a set value of the heating energy of the glow element as a function of the measured temperature, determining a scaled set value of the heating energy as a function of the measured temperature, and wherein the scaled set value is smaller than the set value.

2. The method according to claim 1, wherein the combustion air is conveyed into the burner device in the event that the scaled set value of the heating energy of the glow element is reached, and wherein the fuel is conveyed into the burner device in the event that the set value of the heating energy of the glow element is reached.

3. The method according to claim 1, further comprising:

monitoring, in the burner device, whether a flame is present, determining a delay time, and operating the glow element during the delay time after a time at which the presence of a flame has been determined.

4. The method according to claim 1, further comprising:

switching the glow element on at the beginning of the starting process and operating at a rated power, purging a path passing the combustion air in the burner device with combustion air at the beginning of the starting process, and measuring the temperature of the combustion air after the purging of the path.

5. The method according to claim 1, further comprising:

determining a stabilization time, and starting a regulation of the burner device only after the stabilization time has elapsed after switching off of the glow element.

6. A heating device for heating air and/or heating a liquid, comprising:

a burner device which generates thermal energy by the combustion of a fuel-air mixture, a heat exchanger which transfers the thermal energy generated by the burner device to the air and/or liquid, and a control device, wherein the burner device includes a glow element, a combustion air fan, a fuel pump, and a temperature sensor for measuring the temperature of the combustion air, and wherein the control device is configured so as to perform the method according to claim 1.

7. The method according to claim 2, wherein the scaled set value is between 50% to 100% of the set value.

8. The method according to claim 7, wherein the combustion air is conveyed into the combustion device prior, before the set value of the glow element has been reached.

9. The method according to claim 2, wherein the scaled set value depends on a characteristic of a combustion air fan.

10. The method according to claim 9, wherein the characteristic is a time required by the air fan to reach a set rotational speed.

11. A method of starting a burner device, wherein a mixture of combustion air and fuel is burnt in the burner device, wherein a burning process of the burner device is started by a glow element, the method comprising:

measuring a temperature of the combustion air, determining a set value of the heating energy of the glow element as a function of the measured temperature;

determining a scaled set value of the heating energy as a function of the measured temperature, wherein the scaled set value is smaller than the set value, wherein the combustion air is conveyed into the burner device in the event that the scaled set value of the heating energy of the glow element is reached, and wherein the fuel is conveyed into the burner device in the event that the set value of the heating energy of the glow element is reached.

* * * * *